United States Patent [19]

Raasch et al.

[11] Patent Number: 4,625,505

[45] Date of Patent: Dec. 2, 1986

[54] FRICTION SPINNING DEVICE

[75] Inventors: Hans Raasch; Heinz-Georg Wassenhoven, both of Monchen-Gladbach, Fed. Rep. of Germany

[73] Assignee: W. Schlafhorst & Co., Monchen-Gladbach, Fed. Rep. of Germany

[21] Appl. No.: 706,513

[22] Filed: Feb. 28, 1985

[30] Foreign Application Priority Data

Feb. 29, 1984 [DE] Fed. Rep. of Germany ..... 3407339

[51] Int. Cl.[4] ..... D01H 7/882

[52] U.S. Cl. ..... 57/401

[58] Field of Search ..... 57/401, 400

[56] References Cited

U.S. PATENT DOCUMENTS

| | | | |
|---|---|---|---|
| 4,051,653 | 10/1977 | Mitteregger | 57/401 |
| 4,130,983 | 12/1978 | Dammann et al. | 57/401 X |
| 4,165,600 | 8/1978 | Schippers et al. | 57/401 |
| 4,168,601 | 9/1979 | Didek et al. | 57/401 |
| 4,241,574 | 12/1980 | Turk et al. | 57/401 X |
| 4,362,008 | 12/1982 | Parker et al. | 57/401 X |
| 4,392,343 | 7/1983 | Parker et al. | 57/401 |

FOREIGN PATENT DOCUMENTS

| | | | |
|---|---|---|---|
| 2143858 | 2/1985 | United Kingdom | 57/400 |

*Primary Examiner*—Stuart S. Levy
*Assistant Examiner*—Joseph J. Hail, III
*Attorney, Agent, or Firm*—Horst M. Kasper

[57] ABSTRACT

In order to make the start-up of spinning easier and to obtain a spinning triangular zone which is easily accessible and easily observed, the feeding in of fibers is provided at a rear triangular zone 35 whereas the twisted spun yarn 6 is withdrawn from the other triangular zone 36 in parallel to the plane 34 of the closest distance between the two spinning members 1, 2. The fibers have to pass a narrow section, since the triangular zone 36 is disposed oppositely to the triangular zone 35 versus the line of adjacency of the two spinning members. Suction openings 3' 4' of the suction provisions 3, 4 are directed toward that triangular zone 36 from which the spun yarn is withdrawn. The fiber input location 5' of the fiber feed provision 5 is directed toward the surface of that spinning member 1 whose surface 32 moves in the direction of the first triangular zone 35.

23 Claims, 5 Drawing Figures

FIG. 2
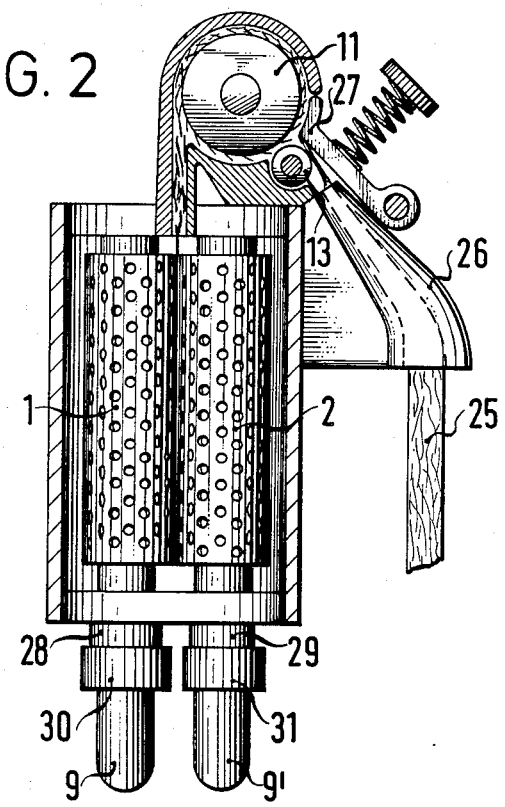
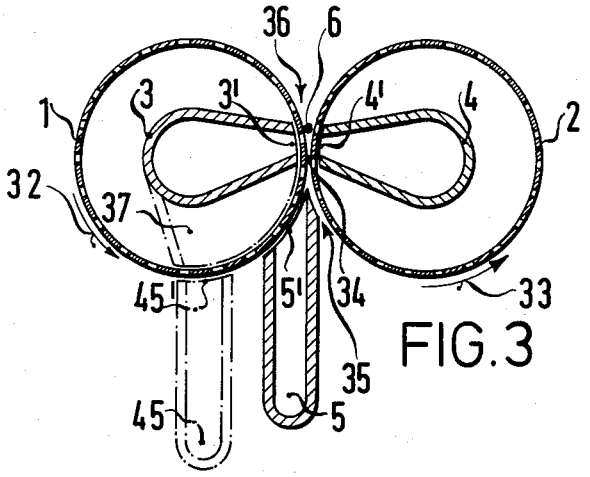
FIG. 3

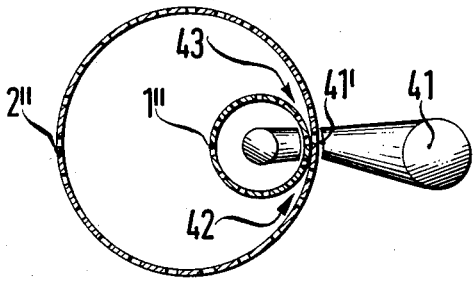
FIG. 5
FIG. 4
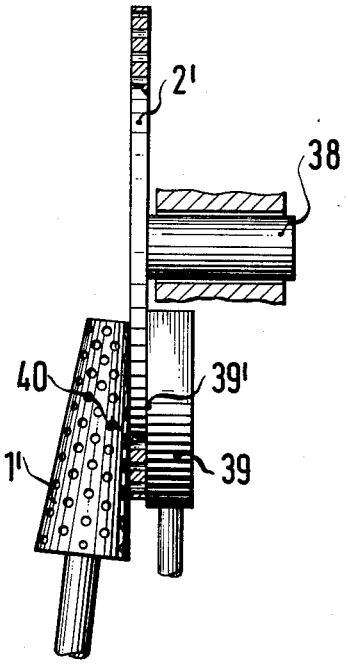

FRICTION SPINNING DEVICE

BACKGROUND OF THE INVENTION

1. Field of the Invention

The present invention relates to a friction spinning device for producing a spun yarn twisted from at least partially existing spun fibers.

2. Brief Description of the Background of the Invention Including Prior Art

Friction spinning devices frequently contain a rotating drum past which the fibers are fed in. The rotating drum with a respective counterpart form an input triangular zone and an output triangular zone, which can also be called an input or output gorge or an input or output gusset. Conventionally, these fibers are fed in at the same triangular zone from which the withdrawal of the spun yarn is performed under provision of twisting. This triangular zone is substantially covered by part of the fiber feed provision. Such an arrangement is disadvantageous for the starting-up after a breakage of the spun yarn or for initially starting up the apparatus, since the starting spun yarn end is introduced with difficulty into the triangular zone from the side. In addition, after an interruption of the spinning process, fibers collect in the triangular zone region and have to be removed before the starting of the spinning. This removal is made difficult by the parts covering the fiber feed device.

SUMMARY OF THE INVENTION

1. Purposes of the Invention

It is an object of the present invention to provide a device for an easy and quick start-up of a spinning machine after a breakage of spun yarn has occurred.

It is a further object of the invention to provide a spinning apparatus where the triangular zone for introducing the fibers into the triangular zone of the rotary spinning members is easily accessible and controllable.

It is a further object of the invention to provide a spinning device where the fiber parts and lint are generally removed from the actual spinning area automatically.

These and other objects and advantages of the present invention will become evident from the description which follows.

2. Brief Description of the Invention

The present invention provides a friction spinning machine for the production of a spun yarn generated at least in part from spun fibers, which friction spinning machine comprises a first spinning member formed by a rotary body and a second spinning member disposed adjacent to the first spinning member, adapted to be rotated in a direction opposite to the first spinning member and forming with the first spinning member an input triangular zone and an output triangular zone. Each triangular zone has one corner at about the location of closest spacing of the spinning members. At least one of the spinning members is provided with a perforated wall. A suction means located close to one of the spinning members is disposed adjacent to the perforated wall such that a suction stream presses the spinning fibers against the surface of the spinning member. There is provided a fiber feed provision and a spun yarn discharge provision. The fiber feed provision and the spun yarn discharge provision are disposed such that the fibers are fed into the input triangular zone and a threaded spun yarn is withdrawn from the output triangular zone in a direction which is near a plane tangential to the outer surfaces of the spinning members at their closest spacing.

The rotary body of the spinning members can be of conical or cylindrical shape.

The suction stream resulting from the suction means can be directed to at least one triangular zone for pressing the fibers against the surface of the respective spinning member.

The plane containing the withdrawal direction of the spun yarn and the line where the first and second spinning member adjoin can form an angle of less than about 10 degrees with the tangential plane of the surfaces of the spinning members along the line of closest spacing between the two spinning members and preferably forms an angle of less than about 2 degrees.

A suction opening of the suction means can be directed toward that triangular zone from which the spun yarn is discharged. The center of the suction flow of the suction openings can be disposed on a spinning member within the region of the output triangular area.

The fiber feed provision can comprise a fiber transfer provision directed toward that spinning member whose surface is moving toward the corner of the input triangular zone near the junction line of the two spinning members.

The suction means coordinated to the respective spinning member can be provided with a suction opening which in correspondence reaches from the fiber input area to the output triangular zone.

A spun yarn sensor for stopping the apparatus in case of a rupturing of an output spun yarn can be provided. Withdrawal rollers for removing an output spun yarn can be furnished. A disintegrating roller for disintegrating spun fibers to provide a charging material for spinning can be provided. A draw-in feed roller for guiding starting material to the disintegrating roller can be provided.

According to a further aspect, the present invention provides a friction spinning method for the production of a spun yarn generated at least in part from spun fibers which comprises the following:

A first spinning member having a rotary body is rotated. A second spinning member disposed adjacent to the first spinning member is rotated in a direction opposite to the first spinning member and forms with the first spinning member an input triangular zone and an output triangular zone, where each triangular zone has one corner at about the location of closest spacing of the spinning members and where at least one of the spinning members is provided with a perforated wall.

Air sucked with a suction means located close to one of the spinning members from the fiber and spun yarn side of the spinning member, presses the spinning fibers against the surface of the spinning member with a suction stream flow.

Fibers are fed to the spinning members with a fiber feed provision, where the fiber feed provision is disposed such that the fibers are fed into an input triangular zone.

A spun yarn is fed out from the spinning members via a spun yarn discharge provision, where the spun yarn discharge provision is disposed such that a threaded spun yarn is withdrawn from an output triangular zone in a direction which is near a plane tangential to the outer surfaces of the spinning members at their closest spacing.

This friction spinning method can further comprise directing the suction stream resulting from the suction means to at least one triangular zone for pressing the fibers against the surface of the respective spinning member.

In this friction spinning method, the plane containing the withdrawal direction of the spun yarn and the line where the first and second spinning member adjoin can form an angle of less than about 10 degrees with the tangential plane of the surfaces of the spinning members along the line of closest spacing between the two spinning members.

The friction spinning method can further comprise directing a suction opening of the suction means toward that triangular zone from which the spun yarn is discharged.

The surface of a spinning member with a suction means can be moved toward the corner of the input triangular zone near the junction line of the two spinning members.

The rupturing of a spun yarn can be detected with a spun yarn sensor, and the apparatus can be stopped if an output spun yarn is ruptured.

Starting material can be guided to a disintegrating roller with a draw-in feed roller. The disintegrating roller can disintegrate spun fibers to provide a charging material for spinning with, and an output spun yarn can be removed with the aid of withdrawal rollers.

Thus in accordance with this invention, the fiber feed provision and spun yarn discharge provision are disposed relative to the spinning members such that the feed of fiber is performed into one triangular zone and the twisted spun yarn can be discharged and withdrawn form the other triangular zone in a direction about parallel to the line of the closest distance of the spinning members.

The present invention is particularly advantageous when applied in a friction spinning apparatus where the withdrawal of the spun yarn is directed against the flow direction of the stream of fibers. Otherwise, the starting up spun yarn would have to be passed by the various accessory parts of the fiber feed provision such as, for example, at the disintegration section. This is particularly difficult and impeding if the friction spinning apparatus is to be started up again automatically after a breakage of the fiber.

According to a further embodiment of the invention, the suction opening of at least one suction provision is directed against that triangular zone from which the withdrawal of the spun yarn occurs. The fibers fed in in a decomposed and disintegrated form pass the narrow place between the two spinning members, then collect in the second triangular zone after experiencing a twist by the spinning members and form a spun yarn which is withdrawn parallel to the narrow place between the spinning members.

According to a further embodiment of the invention, the fiber feed provision comprises a fiber feed location directed toward that spinning member whose surface moves in the direction of the first triangular zone. The surface moving in the direction toward the first triangular zone supports the feeding of fibers beyond the narrow place into the second triangular zone.

According to a further embodiment of the invention, the suction provision of the spinning member comprises a suction opening which reaches from the input location for the fibers to the second triangular zone. This suction opening also supports the feed-in of fibers into the second triangular zone by having an adhesion of the fibers over the full distance under the influence of the suction air on the surface of the respective spinning member.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 2 is a schematic front elevational view of the spinning members, FIG. 3 is a cross sectional view through the spinning members of FIG. 2, FIG. 4 is a schematic view of another embodiment of two spinning members, FIG. 5 is a schematic view of a third embodiment of two spinning members.

DESCRIPTION OF INVENTION AND PREFERRED EMBODIMENTS

Figure 1:
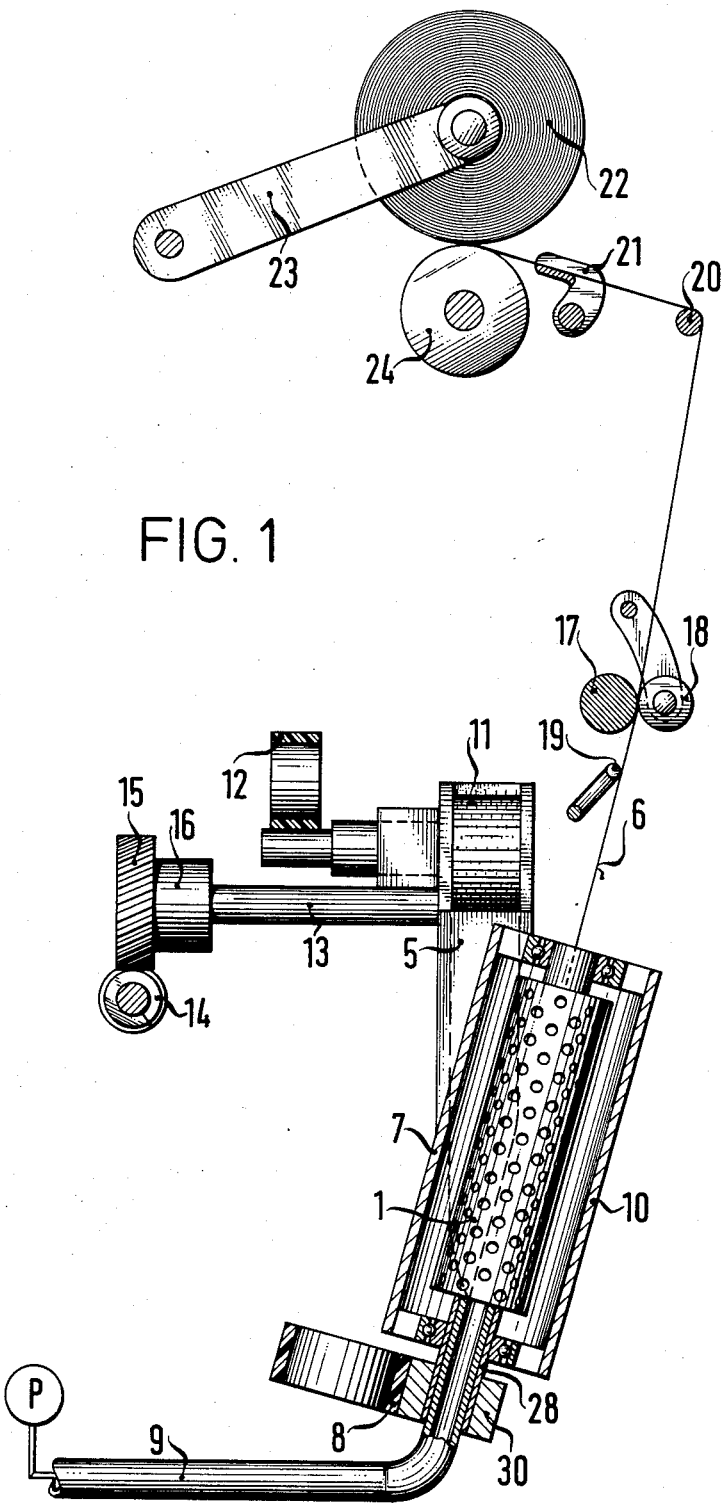
FIG. 1 is a schematic, in part sectional view from the side of a friction spinning apparatus according to the invention.

In accordance with the present invention, there is provided a friction spinning machine for the production of a spun yarn comprised at least in part from spun fibers. The apparatus includes at least one rotatable, cylindrical or conical drum as a first spinning member and also includes a second movable spinning member, movable in an opposite direction relative to the first spinning member and neighboring the first spinning member, where on the two sides of the line of the closest distance of the two spinning members in each case a triangular zone, gorge or gusset is formed and exhibits an end where at least one spinning member includes a perforated wall through which a suction stream is effective against the surface of the spinning member at at least one of the triangular zones for the fed-in spun fibers. The suction stream comes from a suction device whose suction opening is directed toward at least one triangular zone. The fiber feed provision 5 and a spun yarn withdrawal and discharge provision 17, 18 are disposed relative to the spinning members 1, 2 such that the feed-in of the fiber is provided into one triangular zone 35 and the threaded spun yarn 6 is discharged and withdrawn from the other triangular zone 36 in parallel to line 34 representing the closest distance between the spinning members 1, 2.

The suction opening 3', 4' of at least one suction provision 3, 4 is directed against that triangular zone 36 from which the spun yarn is withdrawn. The fiber feed provision 5 can be provided with a fiber input location 5', 5'' directed toward that spinning member 1 whose surface is moving in the direction 32 of the first triangular zone 35. The suction provision 3 of the spinning member 1 can be provided with a suction opening 37 which reaches from the fiber input location 5'' to the second triangular zone 36.

A first embodiment is shown in FIGS. 1 to 3 and comprises two spinning members 1 and 2 which are constructed essentially in the same manner and which are supported rotatably in a casing 7 which can be flipped open. The two spinning members are formed as perforated cylindrical drums. A suction provision 3 is disposed in the interior of the spinning member 1, and a suction provision 4 is disposed in the interior of the spinning member 2. The two suction provisions pass through the length of the respective spinning member. The suction provision 3 is connected to a suction tube 9, and a suction provision 4 is connected to a suction tube 9'. The two suction tubes 9, 9' are connected to a joint low pressure source P, where the air pressure is below atmospheric pressure. The spinning fibers pass from a disintegrating and separating roller 11 to the surface of a the spinning member 1 via a fiber channel 5 which ends at fiber input location 5'. The disintegrating roller 11 is driven by a tangential belt 12. A card sliver 25 passes via a condenser 26 to drawn-in feed roller 13 which rotates slowly. Here the band of fibers is held against spring loaded feed charging box 27, and the band of fibers is slowly advanced against the disintegrating roller 11. The disintegrating roller 11 separates the band of fibers into individual fibers which then pass initially onto the surface of the spinning member 1.

The drive of the spinning members 1 and 2 is provided by a hollow shaft 58 or, respectively, 29, which comprise the whorls or wharves 30 or, respectively, 31. The two whorls or wharves are driven by a tangential belt 8. The suction tubes 9 and 9' are led out via the hollow shafts 28 or, respectively, 29.

The input roller 13 is connected to a worm wheel 15 via an electromagnetic clutch 16. The worm wheel 15 is driven by a worm 14.

The finished spun yarn 6 is withdrawn past a thread sensor provision 19 for the spun yarn and past a discharge shaft 17, The discharge roller 18 rests on the shaft 17. As soon as the thread sensor provision 19 responds, the electromagnetic clutch 16 switches off the feed roller 13 so that a further feeding in of fiber material is stopped.

The spun yarn 6 passes via a redirecting wire 20, a spun yarn guide 21 going back and forth and then runs onto a bobbin 22 which is supported by a bobbin holder 23 and which is driven by a drive drum 24.

The spinning members 1 and 2 rotate in the direction of the arrows 32, 33 as shown in FIG. 3 such that an oppositely directed motion of the surfaces of the two spinning members is present at the narrow place 34 which runs along the line of the closest spacing of the two spinning member with respect to each other. A triangular zone is formed on the two sides of the narrow passage 34, that is, a first triangular zone 35 and a second triangular zone 36. The spun yarn 6 is withdrawn from the second triangular zone 36 in a direction parallel to the line of the smallest distance between the spinning members, that is, parallel to the narrow passage 34. Thus the withdrawal direction is close to a tangential plane of the rotary spinning member at the surface area which is closest to the other spinning member. The suction opening 3' of the suction device 3 and also the suction opening 4' of the suction device 4 is in each case directed against that triangular zone from which the spun yarn is withdrawn, that is, against the second triangular zone 36. On the other hand, the fibers are fed into the first triangular zone 35. FIG. 3 also indicates that the fiber feed provision which is here symbolized by the fiber feed channel 5, comprises a fiber input location 5' directed toward that spinning member whose surface moves in the direction of the first triangular zone 35, that is, in the direction of the arrow 32.

An alternative fiber feed provision 45 is indicated with dash-dotted lines in FIG. 3, which fiber feed provision could replace the fiber feed provision 5.

In addition, it is indicated with dash-dotted lines that the suction provision 3 of the spinning member 1 can be provided with a suction opening 37 which reaches from the fiber input location 45' of the fiber input provision 45 to the second triangular zone 36. Then the fibers would pass from the fiber input location 45' to the surface of the spinning member 1 by adhering in the first triangular zone 35 and pass through the narrow area 34 into the second triangular zone 36 where they then would be twisted into spun yarn 6.

An embodiment deviating from the spinning member provision of the first embodiment is schematically illustrated in FIG. 4. The first spinning member 1' here comprises a rotary, perforated conical drum while the second spinning member 2' is provided as a perforated disk 2' which is driven by a shaft 38. The suction provision 39 of the spinning member 2' is disposed with its suction opening 39' opposite the rear triangular zone from which the spun yarn is withdrawn. The feeding in of the fibers is provided into the front triangular zone 40.

A third embodiment is illustrated schematically in FIG. 5 and comprises, as spinning members 1'' and 2'', two rotary, perforated cylindrical drums which are inserted into each other. The spinning member 1'' in principle is formed as is the spinning member 1 of the first embodiment according to FIG. 3. The second spinning member 2'' is sucked from the outside by having its suction provision 41 with a suction opening directed against the rear triangular zone 43 from which the spun yarn is withdrawn. The feeding of the fiber is performed through the front triangle 42.

According to the first embodiment of FIGS. 1, 2 and 3, after a breakage of the spun yarn or before the start-up of the spinning, the cover 10 of the casing 7 is opened and the triangle 36 is cleaned by blowing air, and a start-up spun yarn is inserted into the triangle. The proper starting up of the spinning is achieved by adding spinning fibers into the other triangle 35 at a simultaneous rotation of the two spinning members 1 and 2.

It will be understood that each of the elements described above, or two or more together, may also find a useful application in other types of system configurations and friction spinning devices differing from the types described above.

While the invention has been illustrated and described as embodied in the context of a friction spinning device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A friction spinning machine for the production of spun yarn generated at least in part from spun fibers comprising a first spinning member formed by a rotary body;

a second spinning member having a surface disposed adjacent to the first spinning member, where the surface is adapted to be moved in a direction about opposite to the surface motion direction of the first spinning member, and forming with the first spinning member an input triangular zone and an output triangular zone, where each triangular zone has one corner at about the location of closest spacing of the spinning members, where the input triangular zone and the output triangular zone are disposed on opposite sides of closest adjacency of two spinning members, and where at least one of the spinning members is provided with a perforated wall;

a suction means located close to one of the spinning members and disposed adjacent to the perforated wall such that a suction stream becomes effective pressing the spinning fibers against the surface of the spinning member;

a fiber feed provision;

a spun yarn discharge provision, where the fiber feed provision and the spun yarn discharge provision are disposed such that the fibers are fed into the input triangular zone and that a threaded spun yarn is withdrawn from the output triangular zone in a direction which is near a plane tangential to the outer surfaces of the spinning members at their closest spacing.

2. The friction spinning machine for the production of spun yarn according to claim 1 wherein the rotary body is of conical shape.

3. The friction spinning machine for the production of spun yarn according to claim 1 wherein the rotary body is of cylindrical shape.

4. The friction spinning machine for the production of spun yarn according to claim 1 wherein the suction stream resulting from the suction means is directed to at least one triangular zone for pressing the fibers against the surface of the respective spinning member.

5. The friction spinning machine for the production of spun yarn according to claim 1 wherein the plane containing the withdrawal direction of the spun yarn and the line where the first and second spinning member adjoin forms an angle of less than about 10 degrees with the tangential plane of the surfaces of the spinning members along the line of closest spacing between the two spinning members.

6. The friction spinning machine for the production of spun yarn according to claim 5 wherein the plane containing the withdrawal direction of the spun yarn and the line where the first and second spinning member adjoin forms an angle of less than about 2 degrees with the tangential plane of the surfaces of the spinning members along the line of closest spacing between the two spinning members.

7. The friction spinning machine for the production of spun yarn according to claim 1 where a suction opening of the suction means is directed toward that triangular zone from which the spun yarn is discharged.

8. The friction spinning machine for the production of spun yarn according to claim 1 wherein the fiber feed provision comprises a fiber transfer provision directed toward that spinning member whose surface is moving toward the corner of the input triangular zone near the junction line of the two spinning members.

9. The friction spinning machine for the production of spun yarn according to claim 1 where the suction means coordinated to the respective spinning member is provided with a suction opening, which in correspondence reaches from the fiber input area to the output triangular zone.

10. The friction spinning machine for the production of spun yarn according to claim 1 further comprising a spun yarn sensor for stopping the apparatus in case of a rupturing of an output spun yarn.

11. The friction spinning machine for the production of spun yarn according to claim 1 further comprising withdrawal rollers for removing an output spun yarn.

12. The friction spinning machine for the production of spun yarn according to claim 1 further comprising a disintegrating roller for disintegrating spun fibers to provide a charging material for spinning.

13. The friction spinning machine for the production of spun yarn according to claim 12 further comprising a draw-in feed roller for guiding starting material to the disintegrating roller.

14. A friction spinning method for the production of spun yarn generated at least in part from spun fibers comprising rotating a first spinning member having a surface and forming a rotary body;

moving the surface of a second spinning member disposed adjacent to the first spinning member in a direction opposite to the direction of motion of an adjacent surface of the first spinning member, and forming with the first spinning member an input triangular zone and an output triangular zone, where each triangular zone has one corner at about the location of closest spacing of the spinning members, where the input triangular zone and the output triangular zone are disposed on opposite sides of closest adjacency of two spinning members, and where at least one of the spinning members is provided with a perforated wall;

sucking air with a suction means located close to one of the spinning members from the fiber and spun yarn side of the spinning member for pressing the spinning fibers against the surface of the spinning member with a suction stream flow;

feeding fibers to the spinning members with a fiber feed provision where the fiber feed provision is disposed such that the fibers are fed into an input triangular zone;

outputting spun yarn from the spinning members via a spun yarn discharge provision, where the spun yarn discharge provision is disposed such that spun yarn is withdrawn from an output triangular zone in a direction which is near a plane tangential to the outer surfaces of the spinning members at their closest spacing.

15. The friction spinning method for the production of spun yarn according to claim 14 further comprising directing the suction stream resulting from the suction means to at least one triangular zone for pressing the fibers against the surface of the respective spinning member.

16. The friction spinning method for the production of spun yarn according to claim 15 wherein the plane containing the withdrawal direction of the spun yarn and the line where the first and second spinning member adjoin forms an angle of less than about 10 degrees with the tangential plane of the surfaces of the spinning members along the line of closest spacing between the two spinning members.

17. The friction spinning method for the production of spun yarn according to claim 14 further comprising
directing a suction opening of the suction means toward that triangular zone, from which the spun yarn is discharged.

18. The friction spinning method for the production of spun yarn according to claim 14 further comprising
moving the surface of a spinning member associated with a suction means toward the corner of the input triangular zone near the junction line of the two spinning members.

19. The friction spinning method for the production of spun yarn according to claim 14 further comprising detecting the rupturing of a spun yarn with a spun yarn sensor; and stopping the apparatus in case of a rupturing of an output spun yarn.

20. The friction spinning method for the production of spun yarn according to claim 14 further comprising
guiding starting material to a disintegrating roller with a draw-in feed roller;
disintegrating spun fibers to provide a charging material for spinning with a disintegrating roller; and
removing output spun yarn with the aid of withdrawal rollers.

21. The friction spinning machine for the production of spun yarn according to claim 1 further comprising
suction openings where the center of the suction flow is disposed on a spinning member within the region of the output triangular area.

22. The friction spinning machine for the production of spun yarn according to claim 1 wherein the second spinning member is provided by a rotary body.

23. The friction spinning machine for the production of spun yarn according to claim 1 wherein the threaded spun yarn is withdrawn from the output triangular zone in a direction parallel to the line of the closest spacing of the spinning members.

* * * * *